US008794932B2

(12) United States Patent
Rogers et al.

(10) Patent No.: US 8,794,932 B2
(45) Date of Patent: Aug. 5, 2014

(54) HYDRAULIC LIFT DEVICE

(75) Inventors: Tracy Rogers, Aztec, NM (US); Matt Montoya, Blanco, NM (US); Curtis Crosby, Farmington, NM (US)

(73) Assignee: Sooner B & B Inc., Farmington, NM (US)

( * ) Notice: Subject to any disclaimer, the term of this patent is extended or adjusted under 35 U.S.C. 154(b) by 355 days.

(21) Appl. No.: 13/154,985

(22) Filed: Jun. 7, 2011

(65) Prior Publication Data

US 2012/0315155 A1 Dec. 13, 2012

(51) Int. Cl.
*F04B 47/04* (2006.01)
*F04B 49/12* (2006.01)

(52) U.S. Cl.
USPC ..... 417/398; 417/63; 417/467

(58) Field of Classification Search
USPC ..... 60/372; 166/68, 105; 417/460, 467, 417/398, 63, 904
See application file for complete search history.

(56) References Cited

U.S. PATENT DOCUMENTS

| | | | | | |
|---|---|---|---|---|---|
| 2,077,665 | A | | 4/1937 | Bennett | |
| 2,151,987 | A | | 3/1939 | Paulus et al. | |
| 2,257,660 | A | | 9/1941 | Tilsy | |
| 2,453,929 | A | | 11/1948 | O'Harah | |
| 2,490,323 | A | * | 12/1949 | Pounds | 60/372 |
| 2,564,285 | A | * | 8/1951 | Smith | 60/372 |
| 2,668,517 | A | | 2/1954 | Craft | |
| 2,702,025 | A | | 2/1955 | Bacchi | |
| 2,724,437 | A | | 11/1955 | Brownscombe et al. | |
| 2,869,469 | A | * | 1/1959 | Williams | 166/78.1 |
| 2,972,863 | A | * | 2/1961 | Hyde | 60/372 |
| 3,461,961 | A | | 8/1969 | Phillips | |
| 3,482,399 | A | | 12/1969 | Lawson | |
| 3,719,238 | A | | 3/1973 | Campbell et al. | |
| 3,863,514 | A | | 2/1975 | Jensen | |
| 4,066,123 | A | | 1/1978 | Skinner et al. | |
| 4,218,195 | A | | 8/1980 | Shure | |
| 4,238,966 | A | | 12/1980 | Carlson et al. | |
| 4,381,174 | A | | 4/1983 | Obler | |
| 4,414,808 | A | * | 11/1983 | Benson | 60/372 |
| 4,530,645 | A | | 7/1985 | Whatley et al. | |
| 4,599,046 | A | | 7/1986 | James | |
| 4,617,030 | A | | 10/1986 | Heath | |
| 4,683,945 | A | | 8/1987 | Rozsa | |
| 4,745,969 | A | | 5/1988 | Henderson | |
| 4,790,376 | A | | 12/1988 | Weeks | |
| 4,878,360 | A | | 11/1989 | Viegas | |

(Continued)

FOREIGN PATENT DOCUMENTS

WO WO 2010/025461 A2 3/2010

*Primary Examiner* — Bryan Lettman
(74) *Attorney, Agent, or Firm* — David B. Tingey; Bryant J. Keller; Kirton McConkie

(57) ABSTRACT

Systems and methods for providing a hydraulic lift device for use in producing a subterranean well. In some cases, the hydraulic lift device includes a hydraulic cylinder having a first cylindrical sleeve slidably coupled to a second cylindrical sleeve, wherein the first and second sleeves define a hollow channel to accommodate passage of a polished rod. In some cases, the first cylindrical sleeve includes a surface for securing a portion of the polished rod. Additionally, in some cases, the lift device includes a port in fluid communication with the hollow channel, wherein the port is configured to receive an inlet line from a hydraulic pump. In some cases, the lift device also includes a guidance system disposed at least partially outside the hydraulic cylinder, wherein the guidance system is configured to prevent axial rotation of the first cylindrical sleeve with resect to the second cylindrical sleeve. Other implementations are described.

19 Claims, 8 Drawing Sheets

(56) References Cited

U.S. PATENT DOCUMENTS

| | | | |
|---|---|---|---|
| 4,959,042 | A | 9/1990 | Tanaka et al. |
| 4,991,400 | A | 2/1991 | Wilkinson |
| 5,199,266 | A | 4/1993 | Johansen |
| 5,386,873 | A | 2/1995 | Harden, III et al. |
| 5,522,463 | A | 6/1996 | Barbee |
| 5,628,704 | A | 5/1997 | Fischler et al. |
| 5,829,958 | A | 11/1998 | Von Hollen |
| 5,960,886 | A | 10/1999 | Morrow |
| 6,113,357 | A | 9/2000 | Dobbs |
| 6,149,408 | A | 11/2000 | Holt |
| 6,230,810 | B1 | 5/2001 | Rivas |
| 6,422,313 | B1 | 7/2002 | Knight |
| 6,601,651 | B2 | 8/2003 | Grant |
| 6,644,400 | B2 | 11/2003 | Irwin, Jr. |
| 6,820,689 | B2 | 11/2004 | Sarada |
| 7,299,879 | B2 | 11/2007 | Irwin, Jr. |
| 7,909,585 | B2 | 3/2011 | Clancy |
| 2002/0139525 | A1 | 10/2002 | Erick |
| 2006/0010865 | A1 | 1/2006 | Walker |
| 2006/0083645 | A1* | 4/2006 | Simmons ..... 417/555.1 |
| 2006/0154763 | A1 | 7/2006 | Serkh |
| 2006/0171821 | A1 | 8/2006 | Brown |
| 2006/0213666 | A1 | 9/2006 | Crawford |
| 2008/0164036 | A1 | 7/2008 | Bullen |
| 2009/0044952 | A1 | 2/2009 | Hunter |
| 2009/0166034 | A1 | 7/2009 | Mundell |
| 2009/0308613 | A1 | 12/2009 | Smith |
| 2010/0054959 | A1 | 3/2010 | Rogers et al. |
| 2010/0054966 | A1 | 3/2010 | Rogers et al. |
| 2011/0061873 | A1 | 3/2011 | Patterson et al. |

* cited by examiner

HYDRAULIC LIFT DEVICE

BACKGROUND OF THE INVENTION

1. Field of the Invention

The present invention relates to an efficient, compact system for lifting a product from a subterranean well. In particular, the present invention relates to systems and methods for providing a hydraulic lift which drives a down hole pump configured to produce a subterranean well.

2. Background and Related Art

Oil wells typically vary in depth from a few hundred feet, to several thousand feet. In many wells there is insufficient subterranean pressure to force the oil and water to the earth's surface. For this reason, some system must be used to pump the crude oil, hydrocarbon gas, produced water and/or hydrocarbon liquids of the producing formation to the earth's surface. The most common system for pumping an oil well is by the installation of a pumping unit at the earth's surface that vertically reciprocates a travelling valve of a subsurface pump.

Traditionally, subsurface pumps have been reciprocated by a pumping device called a pumpjack which operates by the rotation of an eccentric crank driven by a prime mover which may be an engine or an electric motor. A horse head of the pumpjack is attached to a first end of a polished rod which passes through a stuffing box and is further coupled to a sucker rod attached to a traveling valve positioned deep in the well. A walking beam of the pumpjack is oscillated which in turn raises and lowers the horse head thereby oscillating the traveling valve within the subsurface pump. This motion results in a desired liquid being lifted and produced from the well.

While traditionally effective in oil well production, pumpjack units are exceptionally large and heavy pieces of equipment. Pumpjack units are typically built onsite and require a substantially large plot of land on which to construct and install the unit. Pumpjack units further require a prime mover, a gear reducer, a crank and counter arm to provide the necessary speed and oscillating motion for the unit.

Thus, while techniques currently exist that relate to the production of a well, challenges still exist. A need, therefore, exists for a lift system that overcomes the current challenges. Accordingly, it would be an improvement in the art to augment or even replace current techniques with other techniques.

SUMMARY OF THE INVENTION

The present invention relates to an efficient, compact system for lifting a product from a subterranean well. In particular, the present invention relates to systems and methods for providing a hydraulic lift which drives a down hole pump configured to produce a subterranean well.

Implementation of the present invention takes place in association with an artificial lift system for recovery of oil and/or gas from a subterranean well. In some implementations, a hydraulic lift device is providing which includes a hydraulic piston having a first piston sleeve slidably coupled to a second piston sleeve, the first and second piston sleeves further having a hollow channel to accommodate passage of a polished rod connected to a sucker rod associated with a subterranean well, the first piston sleeve further including a surface for securing a portion of the polished rod, the device further including a port in fluid communication with the hollow channel, the port being configured to receive an inlet line from a hydraulic pump. Some implementations further include a sensor for determining a position of the first piston sleeve relative to a position of the second piston sleeve.

In some implementations, the first piston sleeve is slidably inserted within the second piston sleeve. In other implementations, a sensor is provided which includes a piston rod having a first end coupled to a first end of the first piston sleeve, and a second end comprising an object. The sensor further includes a first sensor positioned at a first height relative to the second piston sleeve, and a second sensor positioned at a second height relative to the second piston sleeve, wherein the object is detectable by the first and second sensors when the object is positioned within proximity to the respective sensors.

The position of the first and second sensors determines a stroke length of the hydraulic lift. In some implementations, the object is a magnet or other object that is detectable by the first and second sensors. In other implementations, a computer device is provided for receiving and sending signals from the first and second sensors to a hydraulic pump. For some implementations of the present invention, an expansion chamber is provided between the first piston sleeve and the second piston sleeve whereby to move the first piston sleeve within the second piston sleeve.

For some implementations, the second piston sleeve further includes an inner tube concentrically positioned within an interior of the second piston sleeve. As such, the expansion chamber is defined by a space between an outer surface of the inner tube and an inner surface of the piston sleeve. Some implementations further include a plurality of seals formed between an outer surface of the first piston sleeve and the inner surface of the second piston sleeve, and further seals provided and formed between an inner surface of the first piston sleeve and the outer surface of the inner tube.

Some implementations of the present invention further include methods for manufacturing a hydraulic lift device in accordance with the present invention, the method including steps for providing a hydraulic piston having a first piston sleeve slidably coupled to a second piston sleeve, the first and second piston sleeves further having a hollow channel to accommodate passage of a polished rod connected to a sucker rod associated with a subterranean well, the first piston sleeve further comprising a surface for securing a portion of the polished rod, providing a port in fluid communication with the hollow channel, the port being configured to receive an inlet line from a hydraulic pump, and providing a sensor for determining a position of the first piston sleeve relative to a position of the second piston sleeve. The method may further include a step for slidably inserting the first piston sleeve within the second piston sleeve.

Still further, methods in accordance with the present invention provide steps for attaching a first end of a piston rod to a first end of the first piston sleeve, followed by attaching an object to the second end of the piston rod. Additional steps include steps for coupling a first sensor to a first portion of the second piston sleeve, and coupling a second sensor to a second portion of the second piston sleeve, wherein the object is detectable by the first and second sensors when the object is positioned within proximity to the respective sensors.

Some implementations of the present invention provide a hydraulic lift apparatus which includes a hydraulic cylinder having a stationary portion and a moving portion, the moving portion being slidably coupled to the stationary portion, the moving portion further having a surface for retaining a polished rod coupled to a sucker rod of a subterranean well, a sensor system having a stationary base coupled to the stationary portion of the hydraulic cylinder, the system further including a rod having a first end attached to the moving portion of the hydraulic cylinder, a second end of the rod being positioned within the stationary portion of the system, an object attached to the second end of the rod, a plurality of sensors attached to at least one of the stationary portion of the hydraulic cylinder and the stationary base, the sensors being capable of detecting the object, a distance provided between the plurality of sensors, the distance being equal to a desired stroke length of the hydraulic cylinder; and a hydraulic pump in fluid communication with an expansion chamber of the hydraulic cylinder, the expansion chamber being interposedly positioned between the stationary portion and the moving portion of the hydraulic cylinder.

While the methods, modifications and components of the present invention have proven to be particularly useful in the area oil and/or gas production, those skilled in the art will appreciate that the methods, modifications and components can be used in a variety of different artificial lift applications.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to an efficient, compact system for lifting a product from a subterranean well. In particular, the present invention relates to systems and methods for providing a hydraulic lift which drives a down hole pump configured to produce a subterranean well.

It is emphasized that the present invention, as illustrated in the figures and description herein, may be embodied in other forms. Thus, neither the drawings nor the following more detailed description of the various embodiments of the system and method of the present invention limit the scope of the invention. The drawings and detailed description are merely representative of examples of embodiments of the invention; the substantive scope of the present invention is limited only by the appended claims recited to describe the many embodiments. The various embodiments of the invention will best be understood by reference to the drawings, wherein like elements are designated by like alphanumeric character throughout.

Figure 1A:
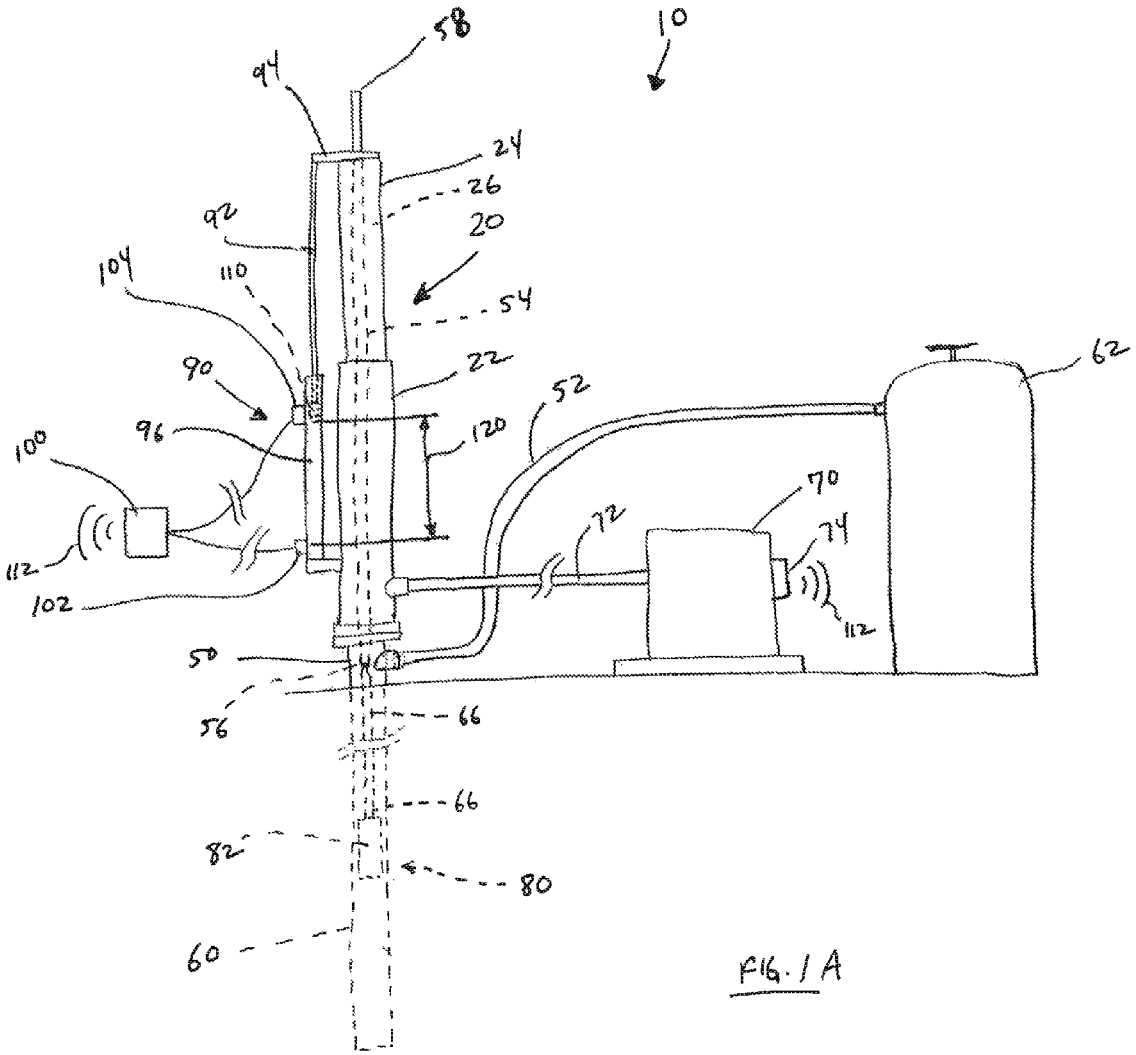
FIG. 1, shown in parts A-C, shows various views of a hydraulic lift in accordance with various representative embodiments of the present invention.
Figure 1B:
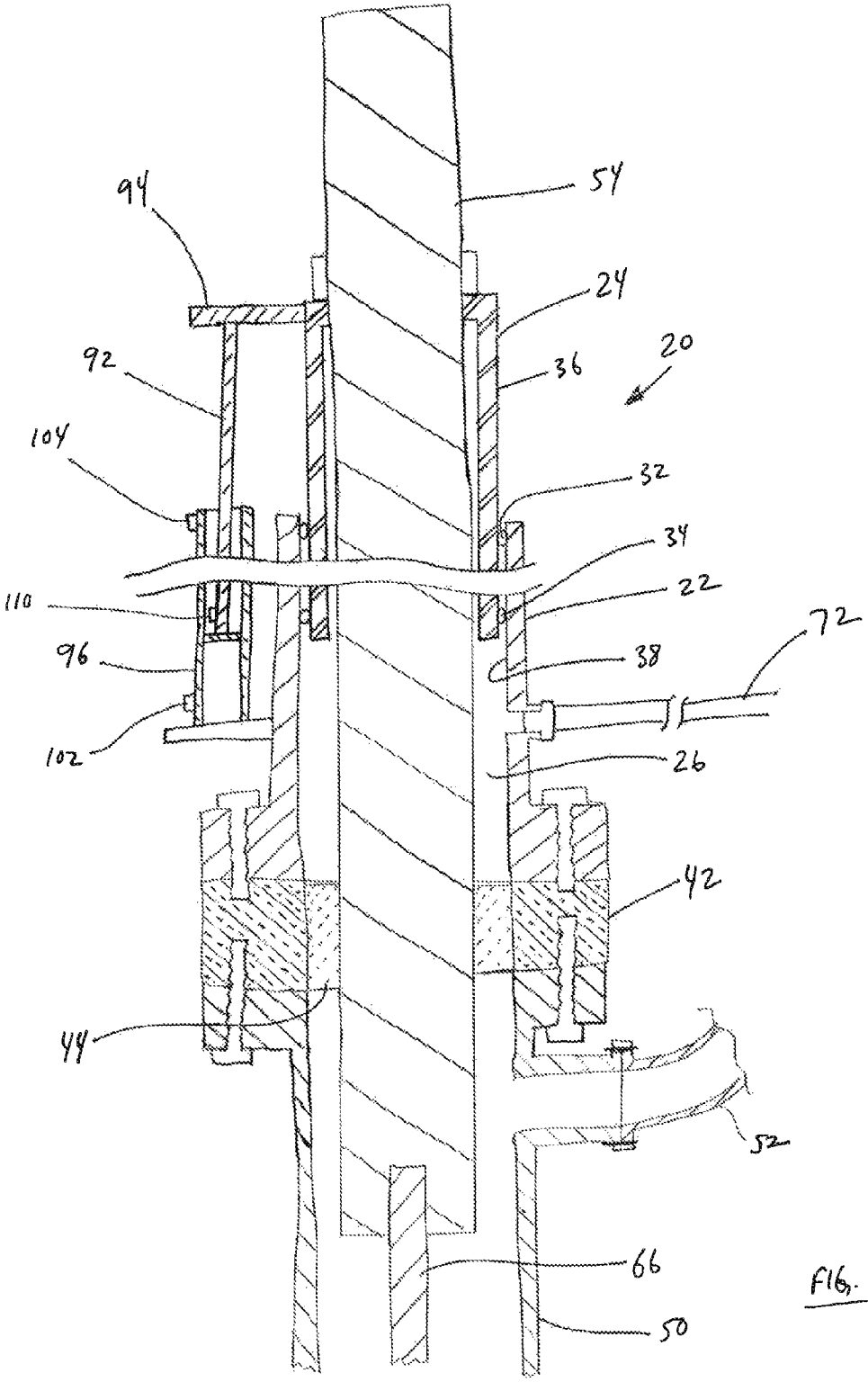
Figure 1C:
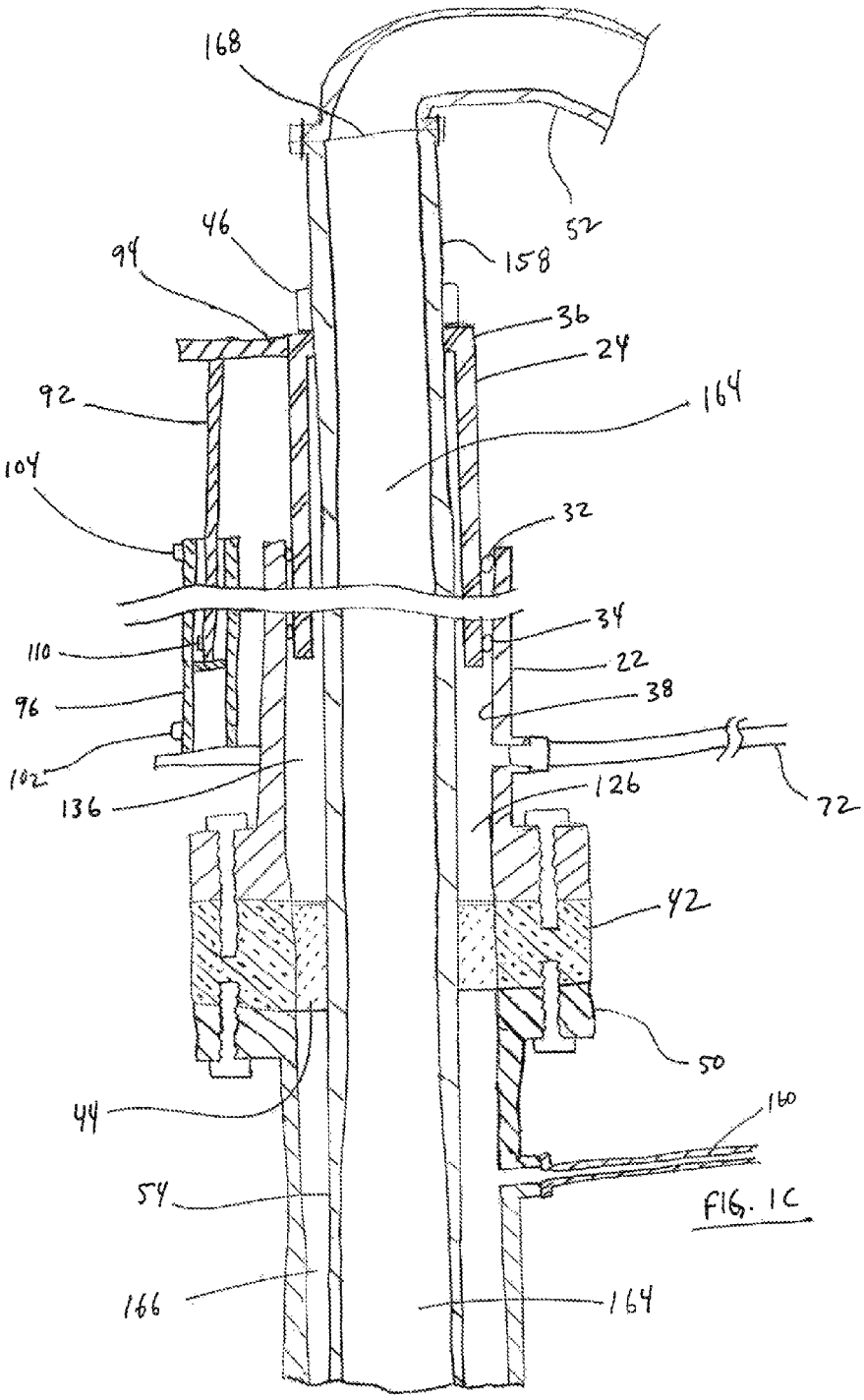

Referring now to FIGS. 1A-1C, an implementation of a hydraulic lift system 10 is shown. In general, system 10 comprises a hydraulic lift 20 which is coupled to a well head 50 having an outlet line 52. A product lifted from an associated subterranean well 60 flows through outlet line 52 and is retained in a storage tank 62. In some embodiments, outlet line 52 is coupled to a pipeline (not shown) wherein a lifted product is placed directly into the pipeline.

Hydraulic lift 20 generally comprises a hydraulic cylinder or piston having an outer piston sleeve 22 and an inner piston sleeve 24. In some embodiments, inner piston sleeve 24 is slidably positioned within outer piston sleeve 22, wherein inner piston sleeve 24 translates inwardly and outwardly within an interior space 126 of outer piston sleeve 22. O-ring seals 32 and 34 are interposedly positioned between outer wall surface 36 of inner piston sleeve 24, and inner wall surface 38 of outer piston sleeve 22, thereby isolating the hollow interior 136 of hydraulic lift 20 from the exterior environment. In some embodiments, inner piston sleeve 24 is moved outwardly relative to a stationary position of outer piston sleeve 22 as hydraulic pressure is increased within the interior space of outer piston sleeve 22. In other embodiments, hydraulic lift 20 comprises an outer piston sleeve slidably positioned over an inner, stationary piston sleeve, wherein the outer piston sleeve translates upwardly and downwardly over the inner piston sleeve's outer surface (not shown). Thus, the teachings of the present invention may be implemented with any hydraulic piston or cylinder configuration.

In some embodiments, lift system 10 further comprises a hydraulic pump 70 in fluid communication with the interior space 126 of outer piston sleeve 22. In some embodiments, hydraulic pump 70 is remotely located from hydraulic lift 20, wherein a hydraulic line 72 is used to provide fluid communication between the two components. Hydraulic pressure is increased within the interior space of outer piston sleeve 22 as fluid is delivered to the interior space 126 from hydraulic pump 70. In some embodiments, hydraulic pump 70 is computer controlled, wherein the direction, timing, pressure and duration of hydraulic pressure being delivered to hydraulic lift 20 is automated or otherwise controlled by a first computer device 74. In some embodiments, a user remote is provided whereby a user may adjust various operating perimeters of hydraulic pump 70 to achieve a desired rate of productivity for subterranean well 60. In other embodiments, hydraulic pump 70 comprises a computer controlled valve (not shown), wherein the computer device digitally controls flow of hydraulic fluid though the valve. Thus, in some embodiments one or more computer devices are used to control the rate of speed and productivity of subterranean well 60.

In some embodiments, outer and inner piston sleeves 22 and 24 comprise a hollow interior channel 26 within which a polished rod 54 is housed, wherein a first end 56 of rod 54 is attached to a sucker line 66 which in turn is attached to the valve 82 of a subsurface pump 80, and wherein a second end 58 of rod 54 is attached to inner piston sleeve 24. In some embodiments, a portion of second end 58 of rod 54 is positioned externally to hollow channel 26 of inner piston sleeve 24, a portion of the second end 58 being coupled to inner piston sleeve 24 by a fastener 46, such as a compression fitting. In other embodiments, inner piston sleeve 24 comprises a solid cross-section (not shown), wherein second end 58 is attached to a solid portion of inner piston sleeve 24.

In some embodiments, hydraulic lift 20 further comprises a gland retainer 42 comprising a dripless seal 44 which forms a seal against the outer surface of polished rod 54. In some embodiments, gland retainer is coupled to outer piston sleeve 22 and wellhead 50 via fasteners, such as lag bolts. In other embodiments, gland retainer 42 is an integrated feature of outer piston sleeve 22 (not shown).

Dripless seal 44 may include any seal compatible with oil and gas applications. In some embodiments, dripless seal 44 comprises a gland seal. In other embodiments, dripless seal is a mechanical face seal. In other embodiments dripless seal 44 comprises a lip seal. Further, in some embodiments dripless seal 44 comprises a plurality of seals. Still further, in some embodiments dripless seal 44 comprises a carbon or polytetrafluoroethylene material.

The translating motion and interaction between gland retainer 42 and polished rod 54 creates a positive pressure within wellhead 50 created by the up and down action of pump 80 thereby lifting a product from the subterranean well. The product is then collected in a storage tank or pipeline 62 via outlet line 52. In some embodiments, polished rod 54 further comprises a hollow rod string 158 that is directly attached to valve 82 of pump 80. Hollow rod string 158 further comprises a lumen 164 which is coupled to outlet line 52, as shown in FIG. 1C. A lifted product is thereby passed through lumen 164 and collected in a storage tank or pipeline 62 via outlet line 52. In some embodiments, dripless seal 44 prevents passage of gases lifted from well 60 from leaking into hollow interior 136 of hydraulic lift 20. Accordingly, in some embodiments lifted gas products are collected within an interstitial space 166 of well 60 and removed from well 60 via a gas outlet port 160.

Some embodiments of the present invention further include a sensor system 90 for controlling a stroke length of hydraulic lift 20, as shown in FIGS. 1A-4. In general, sensor system 90 comprises a series of sensors which detect the position of inner piston sleeve 24 relative to outer piston sleeve 22. In some embodiments, a second computer device 100 receives input from the series of sensors and communicates the sensor input to computer device 74 (e.g., first computer device). Computer device 74 then processes the sensor input to control the flow of hydraulic fluid to hydraulic lift 20.

For example, in some embodiments system 90 comprises a piston rod 92 having a first end coupled to a rod end assembly 94, and a second end being slidably positioned within a non-cushion tube 96. Tube 96 further comprises a maximum insertion sensor 102 adjustably coupled to the outer surface of the tube's base at a desired position, and a maximum height sensor 104 adjustably coupled at a desired position on the tube's outer surface. The second end of piston rod 92 further comprises a magnet 110 or another object that is detectable by sensors 102 and 104.

In some embodiments, the stroke length of hydraulic lift 20 is equal to a distance 120 between adjustable sensor 102 and adjustable sensor 104, wherein the position of sensor 102 indicates maximum insertion of inner piston sleeve 24 within outer piston sleeve 22. Therefore, a user may increase the stroke length of hydraulic lift 20 by increasing distance 120 between sensors 102 and 104 by repositioning 106 at least one of the sensors. Conversely, a user may decrease the stroke length of hydraulic lift 20 by repositioning 106 at least one of sensors 102 and 104 to decrease distance 120.

Figure 2:
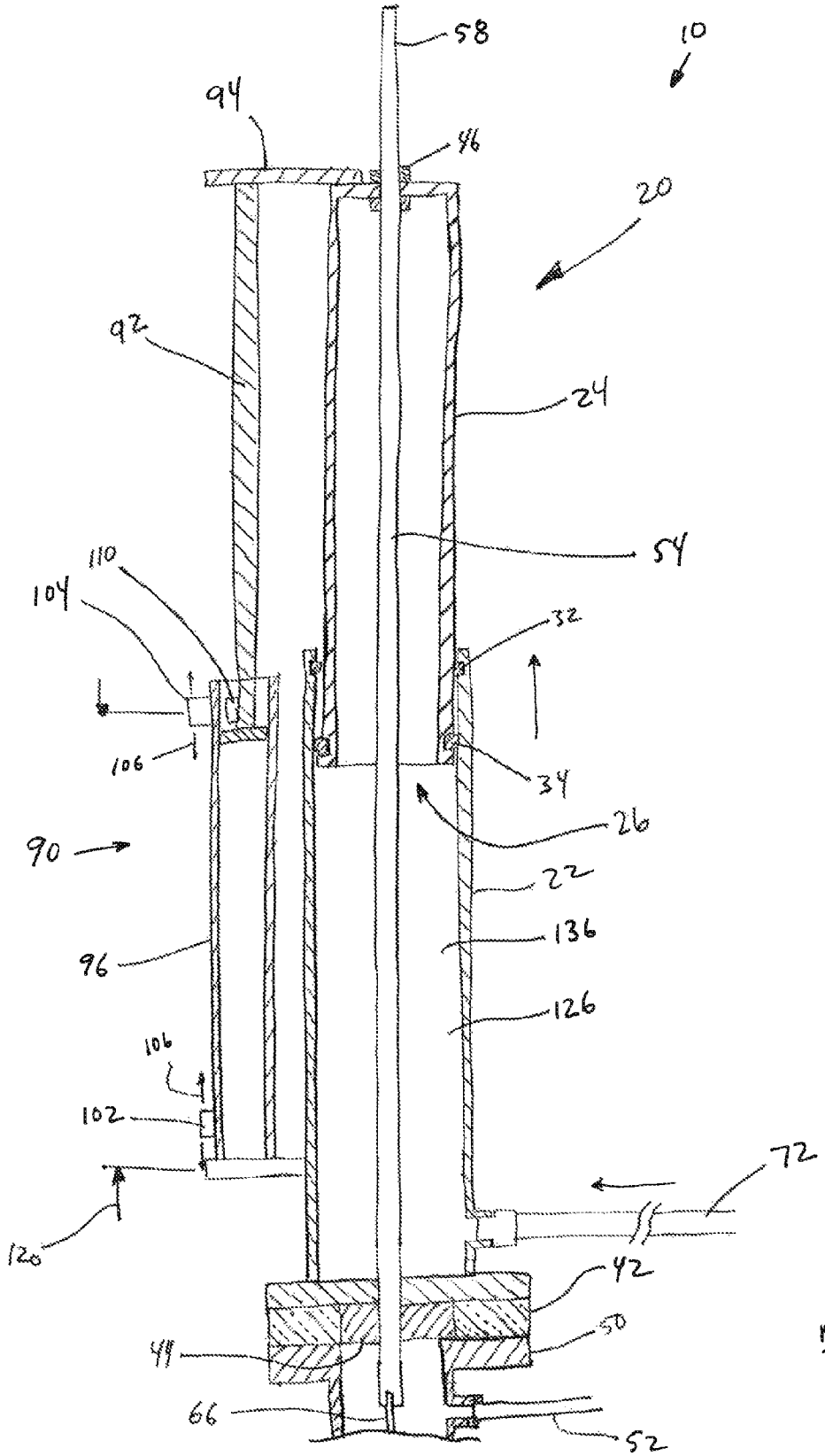
FIG. 2 is a cross-sectional view of a hydraulic lift in accordance with a representative embodiment of the present invention.

In some embodiments, magnet 110 exerts a magnetic field on sensors 102 and 104 thereby communicating the relative position of inner piston sleeve 24. In some embodiments, sensors 102 and 104 convert the sensed magnetic field of magnet 110 into an electronic signal or pulse that is detected by computer device 100. Compute device 100 processes the signal and then sends instructions 112 to computer device 74 which in turn controls the function of hydraulic pump 70. In some embodiments, a signal from adjustable sensor 104 indicates a maximum extended position of inner piston sleeve 24, as shown in FIGS. 1 and 2. This signal is processed and sent to computer device 74 within instructions to cease flow of hydraulic fluid to hydraulic lift 20. In some embodiments, the weight of sucker rod 54 and valve 82 are great enough that inner piston sleeve 24 is drawn into outer piston sleeve 22 by gravitational force alone. In other embodiments, the operation of hydraulic pump 70 is reversed whereby a negative hydraulic pressure is provided within hydraulic lift 20 to draw sleeve 24 within sleeve 22.

Figure 3:
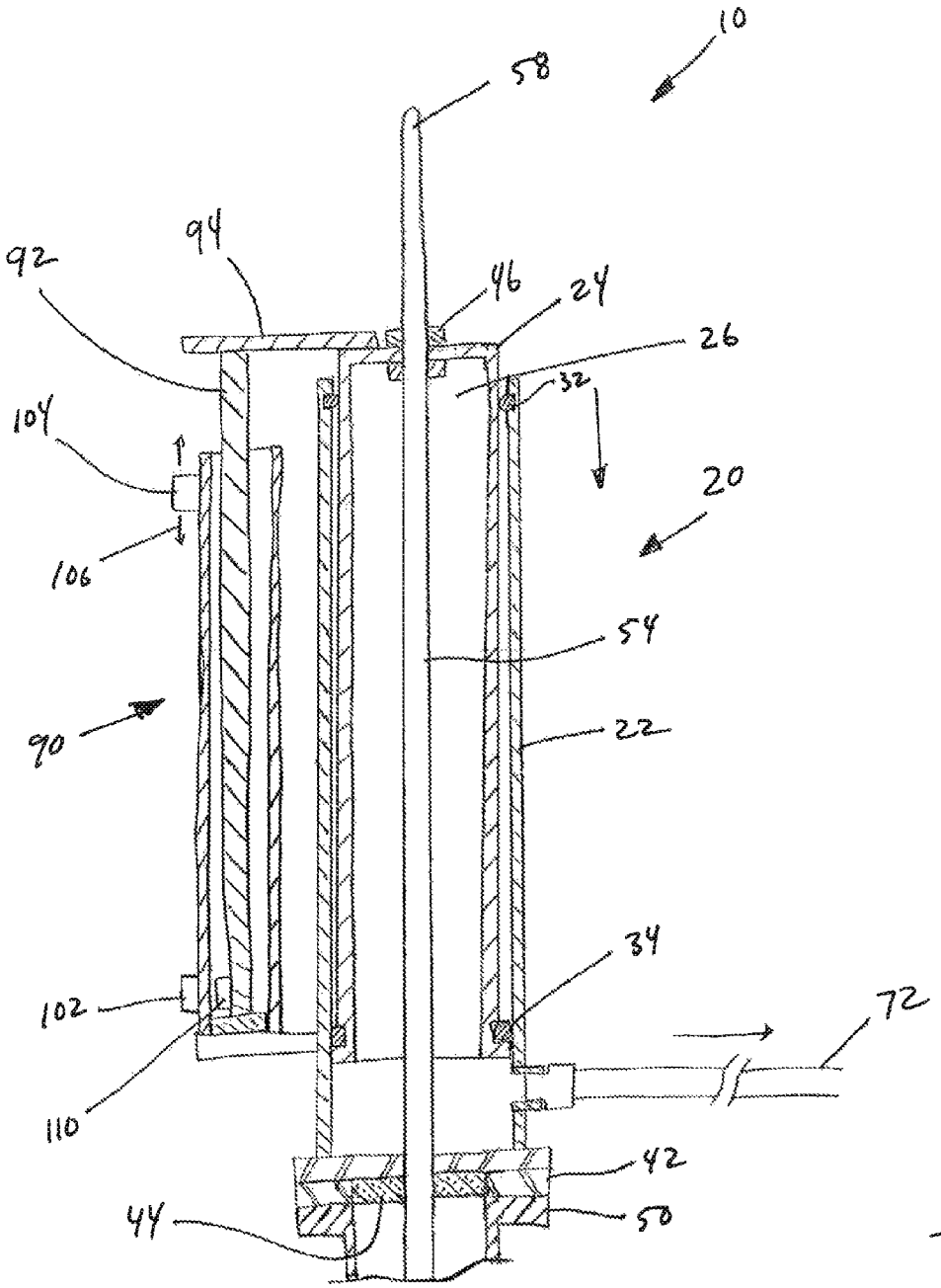
FIG. 3 is a cross-sectional view of a hydraulic lift in accordance with a representative embodiment of the present invention.

A signal from terminal sensor 102 indicates a maximum insertion depth of inner piston sleeve 24 within outer piston sleeve 22, as shown in FIG. 3. This signal is processed and sent to computer device 74 with instructions to resume flow of hydraulic fluid to hydraulic lift 20. The repetition of signals from sensors 102 and 104 provide an oscillating motion of polished rod 54, which motion is characteristic of that achieved by a traditional pumpjack unit. In some embodiments, computer device 100 is computer device 74.

Figure 4:
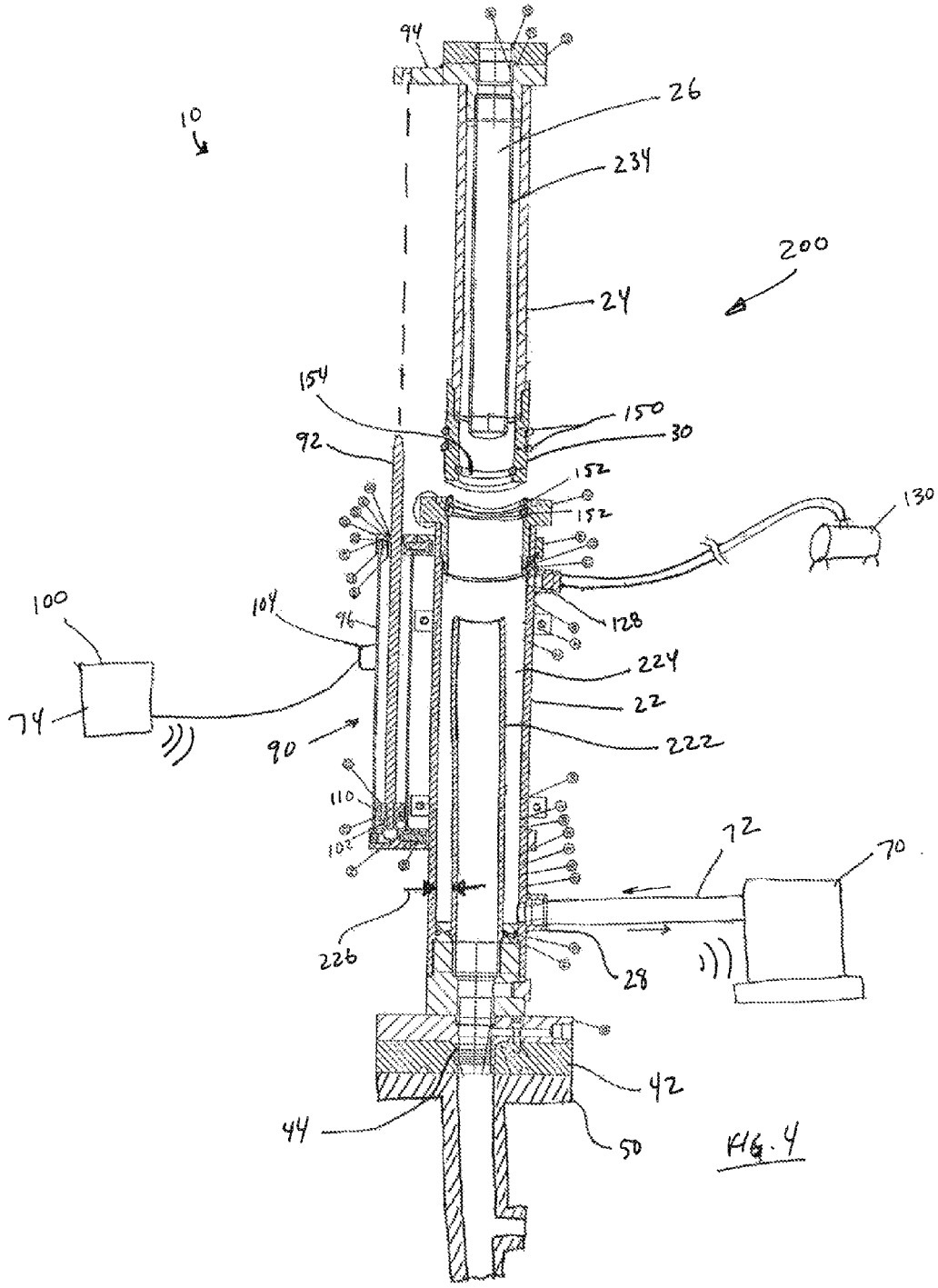
FIG. 4 is a cross-sectional view of a hydraulic lift in accordance with a representative embodiment of the present invention.

Referring now to FIG. 4, an exploded view of a representative commercial embodiment of a hydraulic lift is shown. In some embodiments, hydraulic lift 200 further comprises a plurality of O-ring seals and wipers to control the flow of hydraulic fluid within hydraulic lift 200. In some embodiments, O-ring seals 150 are provided on the outer surface of inner piston sleeve 24 so as to provide a seal between the outer surface of sleeve 24 and the inner surface of outer sleeve 22. Additional O-ring seals 152 are provided on the inner surface of sleeve 22 so as to further provide a seal between the outer surface of sleeve 24 and the inner surface of outer sleeve 22. Additional seals may be provided as necessary control the flow of hydraulic fluid within the system.

In some embodiments, outer piston sleeve 22 further comprises a concentric, inner tube 222 positioned within sleeve 22 so as to provide an annular expansion chamber 224 between the outer surface of tube 222 and the inner surface of sleeve 22. Expansion chamber 224 is in fluid communication with hydraulic pump 70 via inlet line 72 and inlet port 28. The width 226 of expansion chamber 224 is configured to compatibly receive a distal end 30 of inner piston sleeve 24, wherein O-rings 150 provide a seal between distal end 30 and the inner wall surface of sleeve 22, and O-ring 154 provides a seal between the inner surface of sleeve 24 and an outer surface of tube 222. As such, hydraulic fluid pumped into expansion chamber 224 is prevented from bypassing O-rings 150 and 154 thereby displacing inner piston sleeve 24 in an outward direction. In the event that O-rings 150 leak thereby permitting hydraulic fluid to flow into a space between the outer surface of sleeve 24 and the inner surface of sleeve 22, an auxiliary port 128 is provided whereby the trapped hydraulic fluid may be drained and collected in a container 130. In some embodiments, auxiliary port 128 and port 28 are coupled to hydraulic pump 70 via a valve block (not shown) wherein hydraulic pressure is alternated between the two ports to provide a double action hydraulic lift. Alternatively, in some embodiments auxiliary port 128 is coupled to a second hydraulic pump (not shown) to provide a double action hydraulic lift device.

In some embodiments, inner piston sleeve 24 further comprises a concentric, centering tube 234 positioned within sleeve 24, having a diameter configured to slidably insert within the inner diameter of inner tube 222. Centering tube 234 is provided to further stabilize the oscillating motion of inner piston sleeve 24 within outer piston sleeve 22. In some embodiments, centering tube 234 further prevents dust and debris from exiting hollow channel into the interface between inner surface of sleeve 24 and outer surface of inner tube 222.

Figure 5A:
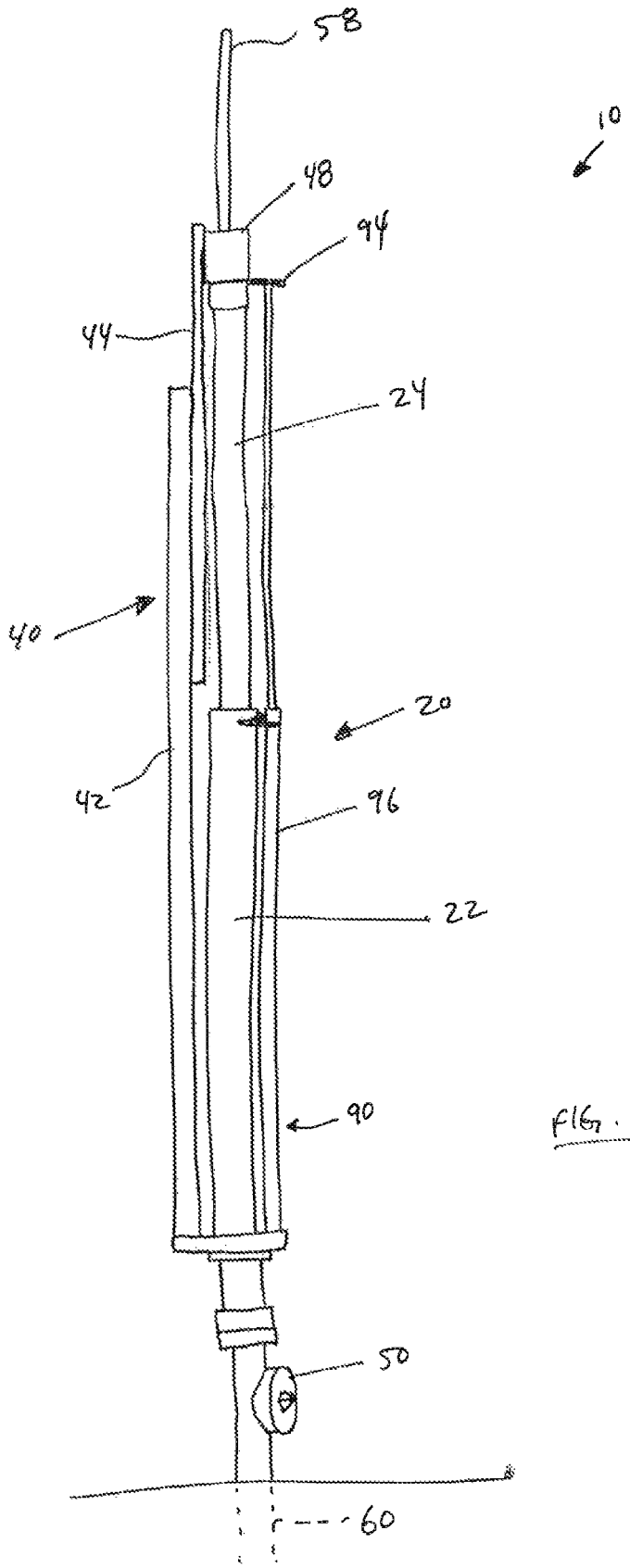
FIGS. 5A-5B show perspective views of a hydraulic lift having an alignment channel in accordance with representative embodiments of the present invention.
Figure 5B:
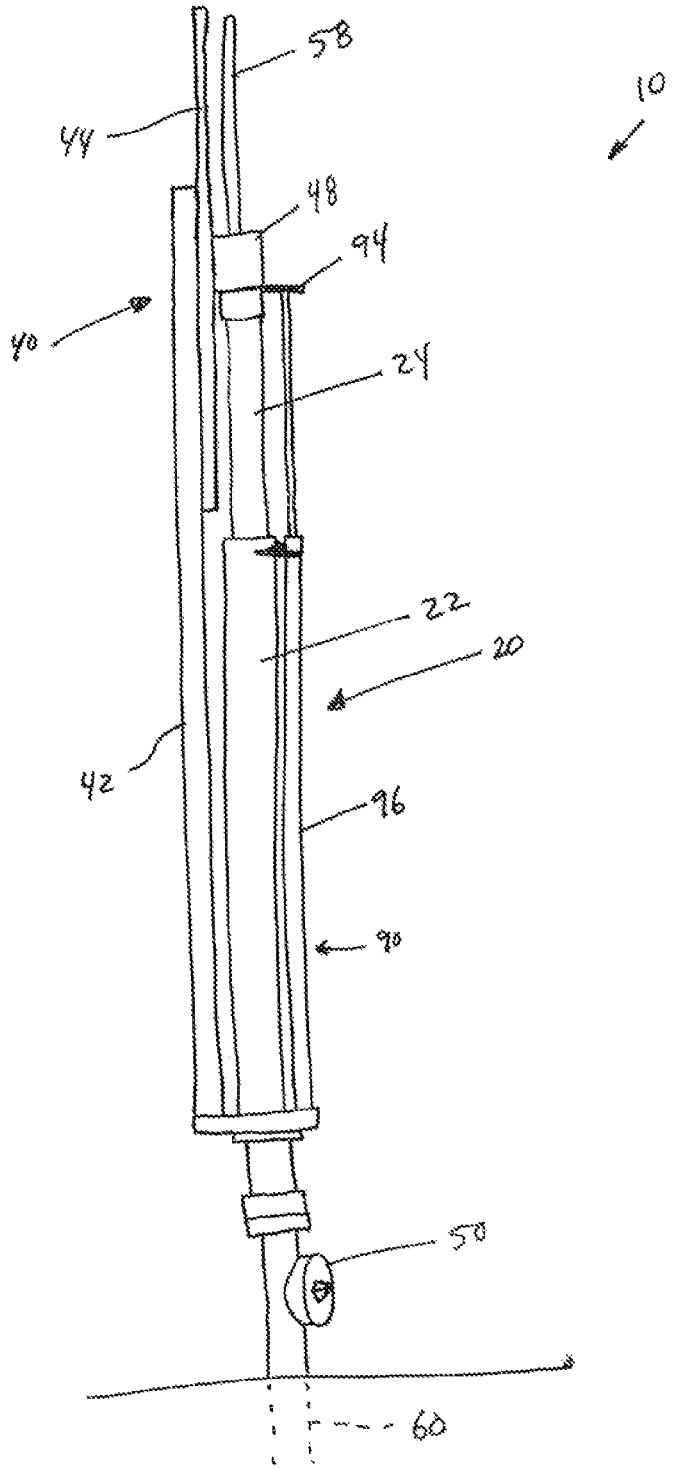

Referring now to FIGS. 5A and 5B, in some embodiments hydraulic lift system 10 further comprises a guidance system 40, whereby to prevent axial rotation of inner piston sleeve 24 relative to outer piston sleeve 22 during operation of the unit. In some embodiments a structural brace 42 is provided which supports an alignment track 44 having a channel in which a cleat 48 translates along the stroke distance of the hydraulic lift 20. Thus, alignment track 44 prevents axial rotation of sleeve 24 within sleeve 22.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A hydraulic lift device, comprising:

a hydraulic cylinder having a first cylindrical sleeve slidably coupled to a second cylindrical sleeve, the first and second cylindrical sleeves further having a hollow channel to accommodate passage of a polished rod associated with a subterranean well, the first cylindrical sleeve further comprising a surface for securing a portion of the polished rod;

a port in fluid communication with the hollow channel, the port being configured to receive an inlet line from a hydraulic pump;

a guidance system disposed at least partially outside of the hydraulic cylinder, wherein the guidance system is configured to prevent axial rotation of the first cylindrical sleeve with respect to the second cylindrical sleeve; and a sensor system comprising a piston rod with an end of the piston rod slidably received inside a non-cushion tube, wherein an overall length of the hydraulic cylinder is configured to increase as hydraulic fluid is pumped into the first cylindrical sleeve, causing the second cylindrical sleeve to slidably translate with respect to the first cylindrical sleeve.

2. The device of claim 1, wherein the first cylindrical sleeve is slidably inserted within the second cylindrical sleeve.

3. The device of claim 1, wherein the sensor system further comprises a sensor for limiting a stroke length of the hydraulic cylinder, wherein a position of the sensor is adjustable to adjust the stroke length.

4. The device of claim 1, wherein the second cylindrical sleeve is stationary with respect to the lift device, wherein the first cylindrical sleeve is configured to slide with respect to the second cylindrical sleeve, and wherein the first cylindrical sleeve is configured to slide over an exterior surface of the second cylindrical sleeve.

5. The device of claim 1, wherein the surface for securing the portion of the polished rod is configured to hang the polished rod from the first cylindrical sleeve.

6. The device of claim 1, further comprising an expansion chamber interposed between the first cylindrical sleeve and the second cylindrical sleeve.

7. The device of claim 6, further comprising an inner tube concentrically positioned within the second cylindrical sleeve, the expansion chamber defining a space between an outer surface of the inner tube and an inner surface of the second cylindrical sleeve.

8. The device of claim 6, further comprising a plurality of seals formed between an outer surface of the first cylindrical sleeve and the inner surface of the second cylindrical sleeve, and an inner surface of the first cylindrical sleeve and the outer surface of the inner tube.

9. A method for manufacturing a hydraulic lift device, the method comprising:

providing a hydraulic cylinder having a first cylindrical sleeve slidably coupled to a second cylindrical sleeve, the first and second cylindrical sleeves further having a hollow channel to accommodate passage of a polished rod, the polished rod being further coupled to a sucker rod associated with a subterranean well, the first cylindrical sleeve further comprising a surface for hanging a portion of the polished rod, wherein an overall length of the hydraulic cylinder is configured to increase as hydraulic fluid is pumped into the first cylindrical sleeve, causing the second cylindrical sleeve to slidably translate with respect to the first cylindrical sleeve;

providing a port in fluid communication with the hollow channel, the port being configured to receive fluid from a hydraulic pump;

a guidance system disposed at least partially outside of the hydraulic cylinder, wherein the guidance system is configured to prevent axial rotation of the first cylindrical sleeve with respect to the second cylindrical sleeve; and a sensor system comprising a piston rod with an end of the piston rod slidably received inside a non-cushion tube.

10. The method of claim 9, further comprising a step for slidably inserting the first piston sleeve within the second piston sleeve.

11. The method of claim 9, further comprising:

hanging a first end of the polished rod from an exterior surface at a first end of the first cylindrical sleeve.

12. The method of claim 11, further comprising a step for operably coupling a computer device to a first sensor and a second sensor of the sensor system, whereby a signal from the first sensor is sent to the hydraulic pump to cause the hydraulic pump to increase pressure in the hydraulic cylinder, and whereby a signal from the second sensor is sent to the hydraulic pump to cause the hydraulic pump to reverse and reduce pressure from within the hydraulic cylinder.

13. The method of claim 9, wherein the guidance system comprises an alignment track running substantially parallel to a longitudinal axis of a longest length of the hydraulic cylinder.

14. The method of claim 9, wherein the polished rod comprises a hollow rod string comprising an inner lumen.

15. The method of claim 9, further comprising a step for interposedly positioning an expansion chamber between the first cylindrical sleeve and the second cylindrical sleeve.

16. The method of claim 15, further comprising a step for concentrically positioning an inner tube within the second cylindrical sleeve, the expansion chamber defining a space between an outer surface of the inner tube and an inner surface of the second cylindrical sleeve.

17. A hydraulic lift apparatus, comprising:

a hydraulic cylinder having a stationary portion and a moving portion, the moving portion being slidably coupled to the stationary portion, the moving portion further having a surface for retaining a polished rod associated with a subterranean well, wherein an overall length of the hydraulic cylinder is configured to increase as hydraulic fluid is pumped into the stationary portion, causing the moving portion to slidably translate with respect to the stationary portion;

a guidance system disposed at least partially outside of the hydraulic cylinder, wherein the guidance system is configured to prevent axial rotation of the moving portion with respect to the stationary portion, and wherein the guidance system comprises an alignment track running substantially parallel to a longitudinal axis of a longest length of the hydraulic cylinder;

a sensor system comprising a piston rod with an end of the piston rod slidably received inside a non-cushion tube; and a hydraulic pump in fluid communication with an expansion chamber of the hydraulic cylinder, the expansion chamber being interposedly positioned between the stationary portion and the moving portion of the hydraulic cylinder.

18. The apparatus of claim 17, wherein a flow of hydraulic fluid into the expansion chamber is controlled by a computer device.

19. The apparatus of claim 18, wherein the polished rod comprises a hollow rod string comprising an inner lumen.

* * * * *